US005651277A

United States Patent [19]

Richardson

[11] Patent Number: 5,651,277

[45] Date of Patent: Jul. 29, 1997

[54] CLUTCH MECHANISM FOR AUTOMATIC WASHER

[75] Inventor: Curtis G. Richardson, Herrin, Ill.

[73] Assignee: Maytag Corporation, Newton, Iowa

[21] Appl. No.: 501,473

[22] Filed: Jul. 12, 1995

[51] Int. Cl.[6] ..... D06F 37/40

[52] U.S. Cl. ..... 68/23.7; 68/23.3; 68/23.6; 68/133; 68/134

[58] Field of Search ..... 68/23.6, 23.1, 68/23.2, 23.3, 23.5, 23.7; 134/131, 132, 133, 134

[56] References Cited

U.S. PATENT DOCUMENTS

| | | | |
|---|---|---|---|
| 2,588,963 | 3/1952 | Chapin . | |
| 2,609,697 | 9/1952 | Ruscoe | 68/23.7 |
| 2,633,144 | 3/1953 | Smith . | |
| 2,633,145 | 3/1953 | Smith . | |
| 2,635,445 | 4/1953 | Smith . | |
| 2,665,567 | 1/1954 | Thiele | 68/23.7 |
| 4,813,248 | 3/1989 | Smith et al. . | |
| 4,837,882 | 6/1989 | Brenner et al. . | |
| 5,150,589 | 9/1992 | Williams et al. . | |
| 5,208,931 | 5/1993 | Williams et al. | 68/23.7 |
| 5,353,613 | 10/1994 | Smith et al. . | |
| 5,381,677 | 1/1995 | Park et al. | 68/23.7 |

FOREIGN PATENT DOCUMENTS

| | | | |
|---|---|---|---|
| 915997 | 1/1963 | United Kingdom | 68/23.7 |

*Primary Examiner*—Frankie L. Stinson
*Attorney, Agent, or Firm*—Zarley, McKee, Thomte, Voorhees, & Sease

[57] ABSTRACT

An automatic washer includes an elongated shaft mounted to a motor for rotation about the longitudinal axis of the shaft. A fabric basket is rotatably mounted to the shaft and an agitator is attached to the shaft above the fabric basket. A clutch is positioned between the agitator and the fabric basket and is movable from a disengaged position wherein the agitator rotates independently of the basket to an engaged position wherein the agitator rotates in unison with the basket. The clutch is movable from its engaged position to its disengaged position in response to the rise of washing fluid within the washing basket.

12 Claims, 3 Drawing Sheets

124
118
130
112
116
124
114
122
120
122
72
100
94
96
110
102
104
106
108

85
80
82
84
72
88
86
92
92
86

CLUTCH MECHANISM FOR AUTOMATIC WASHER

BACKGROUND OF THE INVENTION

The present invention relates to a clutch mechanism for automatic washers.

In a direct drive washing machine the drive motor is initially coupled to the agitator for providing back and forth reciprocating movement to promote mechanical turnover of the clothing during the washing operation. Upon completion of agitation, the drive motor must then be additionally coupled to the perforated inner fabric basket of the washing machine in order to rotate the basket and the agitator in unison at high speed and provide centrifugal extraction of wash water from the fabrics being washed.

In some prior art devices the basket and agitator float upwardly away from the bottom wall of the outer tub when the water level is above a predetermined height. This disengages the agitator from the basket and permits the agitator to rotate independently of the basket. When the water level drops below the predetermined level the agitator lowers down into engagement with the washing basket and the two are coupled together and can rotate together during the spin cycle.

In these prior art devices, because of the large mass of the agitator, a large amount of water is required in order to float the agitator to the desired height.

Therefore a primary object of the present invention is the provision of an improved clutch mechanism for an automatic washer.

A further object of the present invention is the provision of an improved clutch mechanism which requires less water for actuation then prior clutch mechanisms.

A further object of the present invention is the provision of an improved clutch mechanism which does not require the basket and the agitator to move vertically with respect to one another.

A further object of the present invention is the provision of a clutch mechanism which is simple in construction, durable in use, and efficient in operation.

SUMMARY OF THE INVENTION

The foregoing objects are achieved by an automatic washer for washing fabrics with a washing fluid. The washer comprises a frame, an elongated shaft having a shaft axis, and a motor mounted in fixed relation to the frame and being connected to the shaft for rotating the shaft about its shaft axis. A fabric washing basket is rotatably mounted to the shaft for rotation independently of the shaft about the shaft axis. The washing basket includes a gripping surface.

An agitator is attached to the shaft for rotation with the shaft responsive to motor operation. A clutch is positioned between the washing basket and the agitator. The clutch includes a gripping surface presented toward the gripping surface of the basket.

The clutch is movable from a disengaged position wherein the gripping surface of the clutch is spaced from the gripping surface of the basket to an engaged position wherein the two gripping surfaces retentively engage one another. The clutch and the agitator engage one another when the clutch is in its engaged position to prevent relative rotation therebetween whereby the basket, the clutch, and the agitator will rotate together when the clutch is in its engaged position.

The clutch is movable from the engaged position to the disengaged position in response to the rise of level of the washing fluid above a predetermined level within the washing basket.

DETAILED DESCRIPTION OF THE PREFERRED EMBODIMENT

Figure 1:
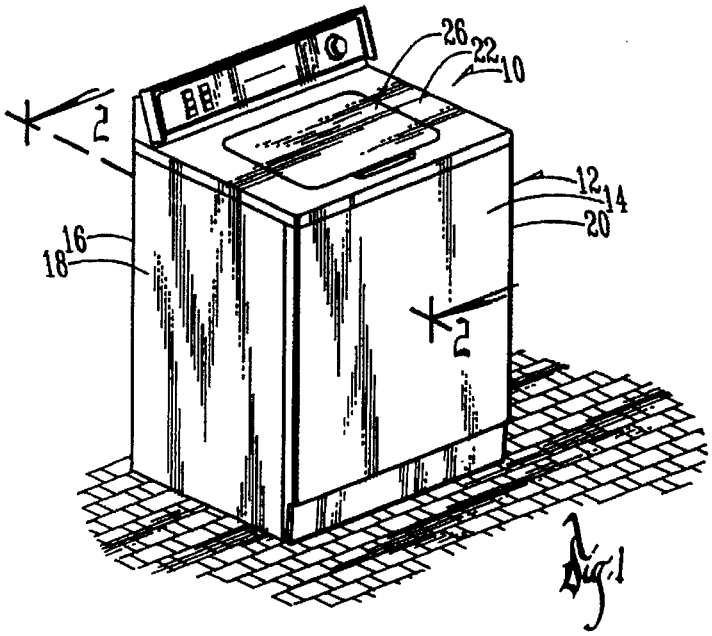
FIG. 1 is a pictorial view of an automatic washing machine containing the clutch mechanism of the present invention.
Figure 2:
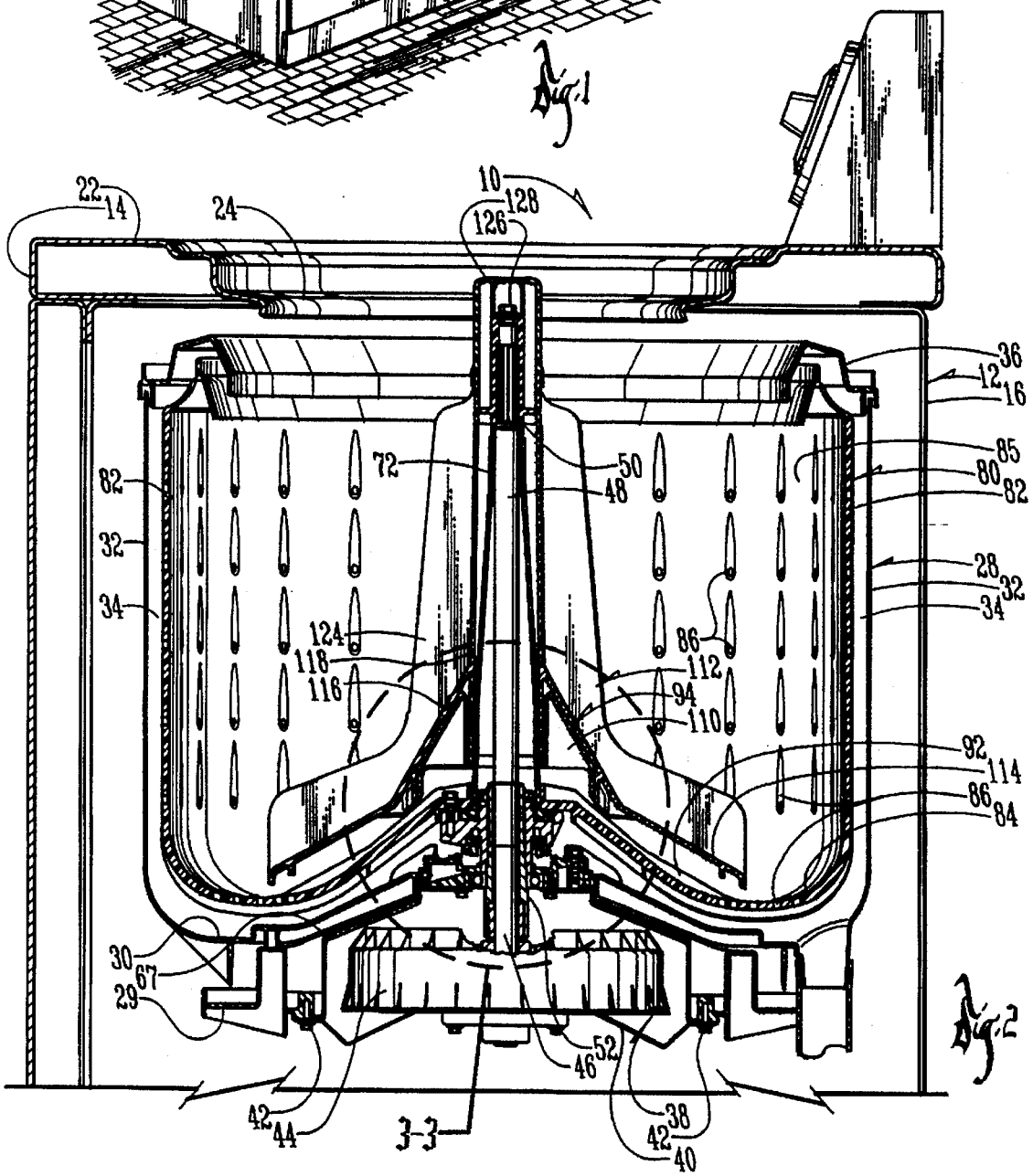
FIG. 2 is a sectional view taken along line 2—2 of FIG. 1.

Referring to the drawings, the numeral 10 generally designates the automatic washing machine of the present invention. Washing machine 10 includes a cabinet 12 having a front wall 14, a rear wall 16, side walls 18, 20 and a top wall 22. The top wall 22 includes a lid opening 24 having a lid 26.

Within the cabinet 12 is suspended an outer tub 28. Tub 28 is held in a fixed position with respect to the cabinet 12 by means of struts (not shown) which extend upwardly to the four corners of the cabinet and which are attached at their lower ends to a mounting plate 29 secured to the bottom of the tub 28. Tub 28 includes a bottom wall 30, and side walls 32 which form a tub cavity 34. Fitted over the top edges of side walls 32 of the tub 28 is an annular top cover 36.

Figure 3:
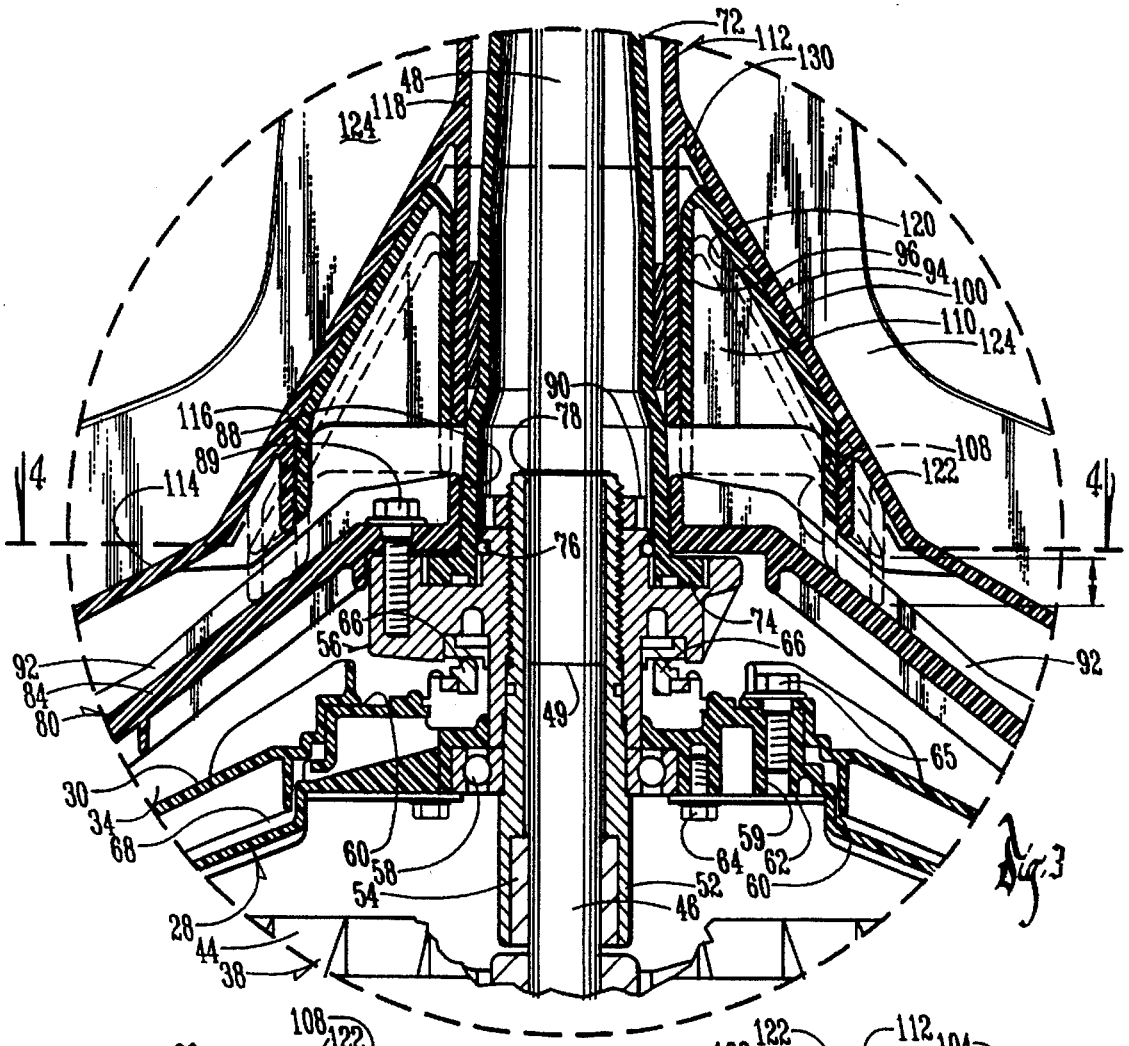
FIG. 3 is an enlarged detail view taken along line 3—3 of FIG. 2.
Figure 4:
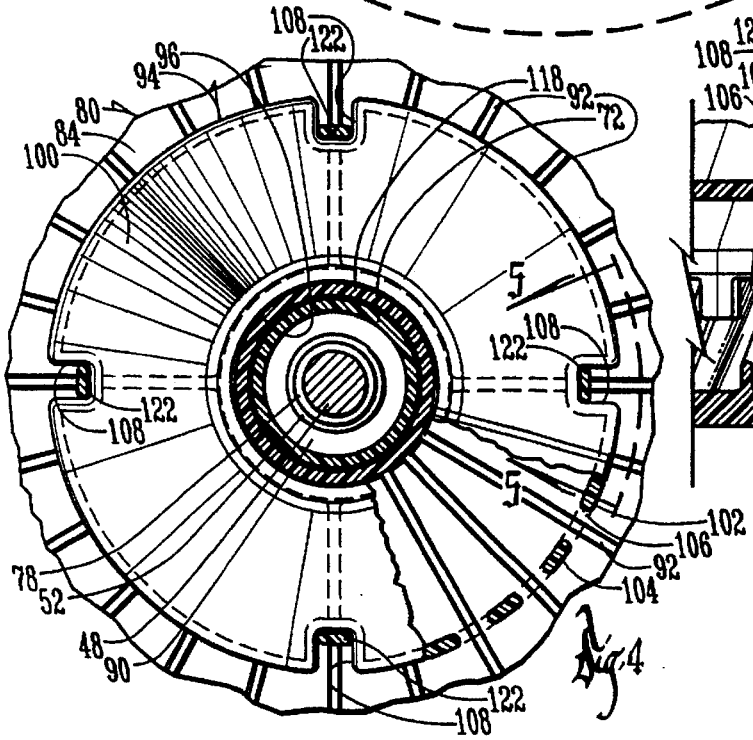
FIG. 4 is a sectional view taken along line 4—4 of FIG. 3.
Figure 5:
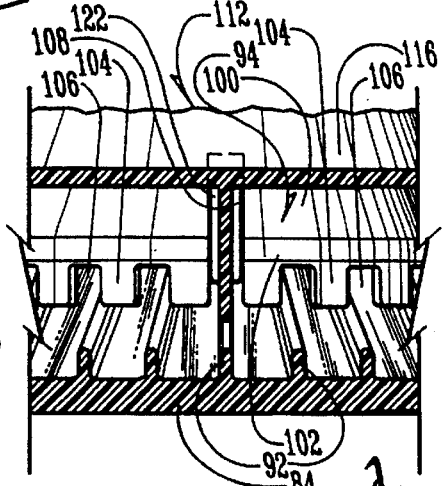
FIG. 5 is a sectional view taken along line 5—5 of FIG. 4.

A motor 38 is attached to the mounting plate 29 and the bottom wall of the tub 28 by means of brackets 40 which are bolted to the mounting plate 29 by bolts 42. Motor 38 includes an exterior rotor 44 which is adapted to rotate a motor output shaft 46. The upper end of shaft 46 is coupled to an agitator shaft 48 by threading the two shafts 46, 48 together or by other suitable coupling means. The juncture between shafts 48, 46 is best shown at 49 (FIG. 3). The upper end of agitator shaft 48 includes a plurality of longitudinal splines 50.

A sleeve 52 (FIG. 3) slidably fits over the juncture 49 between the two shafts 46, 48 and is rotatable thereon. A bearing 54 facilitates this rotatable mounting. Sleeve 52 is threaded on its outer surface and is threadably attached to a hub 56. Sleeve 52 is rotatably mounted in a bearing 58 which is mounted within a bearing housing 59 which is part of mounting plate 29. The bearing 58 is held within the bearing housing 59 by means of a locking plate 62 which is bolted to bearing housing 59 by means of bolts 64. The mounting plate 29 is also held in place by means of bolts 65 which extend through the bottom wall 30 of the tub 28 and into the mounting plate 29. A rotary seal 66 is carried by the mounting plate 29 and prevents water from exiting through the opening 60 of the bottom wall 30.

A cone tube 72 includes a bottom flange 74 which rests upon and mates with the upper surface of hub 56. An o ring seal 76 between hub 56 and the cone tube 72 provides a watertight seal therebetween.

A locking ring 78 secures the upper end of sleeve 52 against upward movement on shaft 48.

Fitted within outer tub 28 is a washing basket 80 having side walls 82 and a bottom wall 84 which form a basket cavity 85. A plurality of drain holes 86 are in the bottom wall 84 and in the side walls 82 of basket 80 and provide fluid communication between the tub cavity 34 and the basket cavity 85.

Bottom wall 84 of basket 80 includes a central opening 88. Extending upwardly through central opening 88 is the cone tube 72. A plurality of bolts 89 secure the bottom wall 84 of basket 80 to the hub 56 so that they rotate in unison with respect to shafts 46, 48 by means of bearing 54. A nut 90 is positioned between the upper end of sleeve 52 and the interior of cone shaped tube 72.

Figure 6:
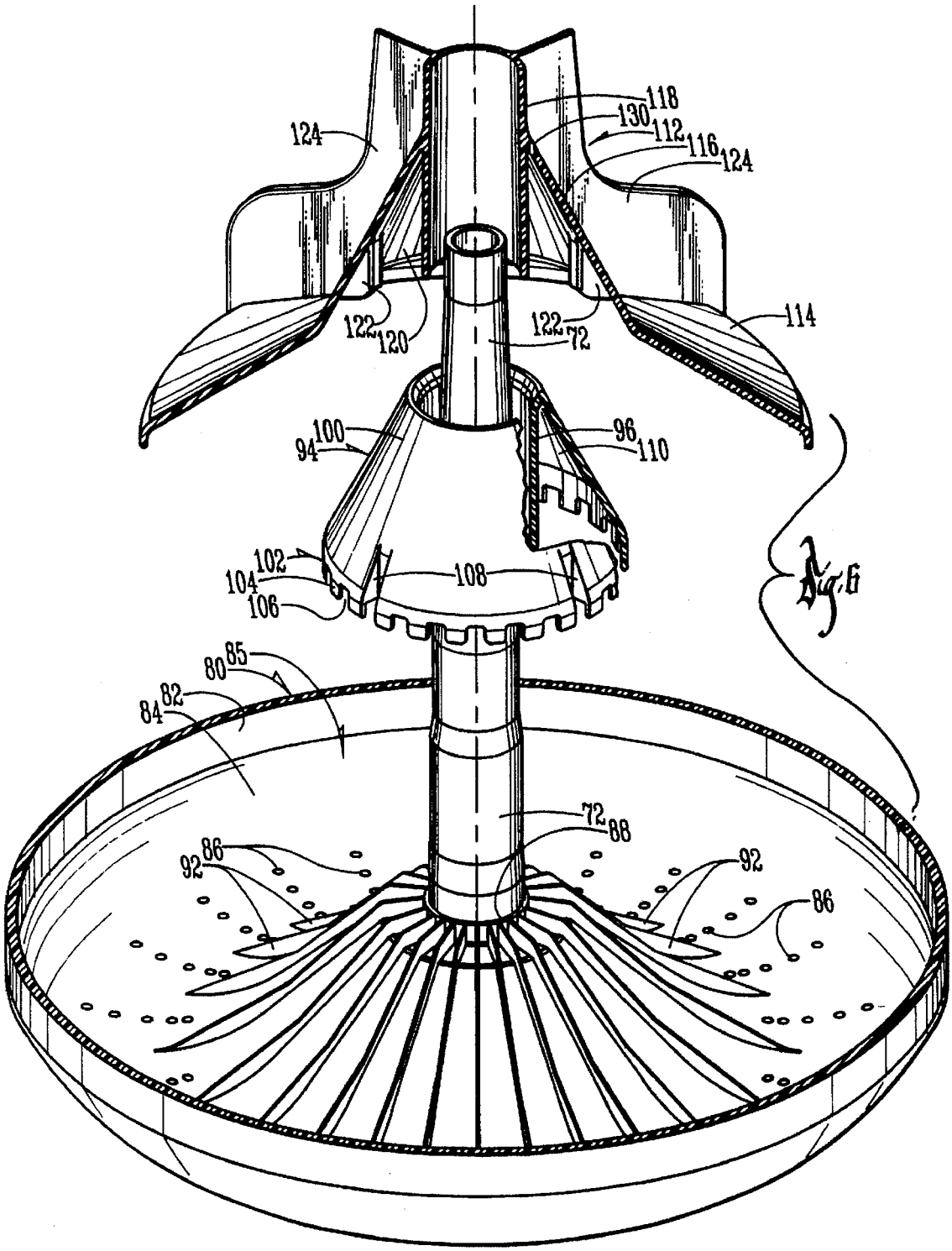
FIG. 6 is an enlarged exploded pictorial view showing the relationship of the basket bottom wall, the clutch, and the agitator.

Bottom wall 84, as can be best seen in FIG. 6 includes a plurality of radially extending ribs 92. A clutch 94 is positioned above bottom wall 84 and includes a central clutch tube 96 which surrounds the cone tube 72. Extending downwardly from the upper end of central clutch tube 96 is an outer cone surface 100 which terminates at its lower end in an apron 102. The peripheral lower edge of apron 102 includes alternating teeth 104 and slots 106. Also, four generally vertical guide slots 108 are spaced around the apron 102 of outer cone surface 100.

The outer cone surface 100 and the clutch tube 96 combine to form an air chamber 110 which, when the clutch 94 is emersed in water, gives buoyancy to the clutch 94 so that it will float upwardly in the water.

Above clutch 94 is an agitator 112 having an apron or skirt 114 at its lower end and having cone shaped wall 116 extending upwardly therefrom and a downwardly and outwardly extending central tube 118. The cone shaped wall 116 and the downwardly extending portion of the central tube 118 form a float chamber 120 which is adapted to mate with and receive the outer cone surface 100 of clutch 94. Protruding radially inwardly from the cone shaped wall 116 of the agitator 112 are four spaced apart guide ribs 122 which are adapted to fit within the guide slots 108 of clutch 94. This permits the clutch 94 to move vertically from its disengaged position shown in solid lines in FIG. 3 to its engaged position which is shown in shadow lines in FIG. 3. The guide ribs 122 cause the clutch to be engaged by the agitator 112 so that the two will rotate in unison when the clutch 94 is in both its engaged and disengaged positions.

Referring to FIGS. 3–6, the teeth 104 and the slots 106 at the lower edge of clutch 94 engage the ribs 92 on the bottom wall 84 of the washing basket 80 when the clutch 94 is in its lowered engaged position. In this position the agitator 112, the clutch 94, and the washing basket 80 are coupled together so that they will rotate in unison through motor 38 and shafts 46 and 48. When the clutch 94 is in its elevated or disengaged position, the agitator 112 is free to rotate independently of the basket 80.

Agitator 112 includes radially extending agitator blades 124, and is fixedly attached to the upper end of shaft 48 by means of a bolt 126 and also by means of the splines 50 at the upper end of shaft 48. Press fitted over the upper end of the agitator 112 is a cap 128.

In operation, the washing machine 10 is initially filled with water for the washing cycle. As the water level rises within the outer tub 28 and the washing basket 80, the clutch 94 floats upwardly to its disengaged position. As the washing cycle begins, the shaft 48 is driven in a rotating reciprocating motion to cause the agitator 112 to move back and forth for washing the fabrics. Because the clutch 94 is in its disengaged position, the washing basket 80 does not move in unison with the agitator 112.

When the washing cycle is complete, the water is drained from the outer tub 28 and the washing basket 80. This causes the clutch 94 to fall by gravity to its engaged position wherein the teeth 104 engage the ribs 92 of the bottom wall 84. This couples the agitator 112, the clutch 94, and the washing basket 80 together so that they will rotate in unison. A vent hole 130 is provided in the cone shaped wall 116 of agitator 112 so as to release any vacuum between the clutch 94 and agitator 112 when the clutch 94 is in its elevated position.

As the spin portion of the washing cycle begins, the motor 38 rotates the shaft 48 in a single direction. Because the agitator 112, the clutch 94, and the washing basket 80 are coupled together, these three components begin rotating in unison so as to spin the washing basket 80 and cause the moisture in the fabrics to be removed by centrifugal force through the apertures 86 in side wall 82 of washing basket 80.

Several advantages are obtained by the use of the floating clutch 94 within the agitator 112 over prior devices which require the entire agitator to float. Because the mass of the clutch 94 is less than the mass of the agitator 112, the clutch 94 will move much more easily with less buoyancy force than was the case with prior agitators.

Also with prior devices, the need for the agitator to move upwardly and downwardly was sometimes hindered by fabrics and clothing in the basket. In the present invention, the clutch 94 is protected from the clothing and is free to move upwardly and downwardly without any hindrance by the fabrics.

The ribs 122 on the interior of the float chamber 120 engage the clutch 94 so as to insure that the clutch 94 and the agitator 112 will rotate in unison regardless of whether the clutch is in its engaged or disengaged position.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. An automatic washer for washing fabrics with a washing fluid comprising:

a frame;

an elongated shaft having a shaft axis;

a motor mounted in fixed relation to said frame and being connected to said shaft for rotating said shaft about said shaft axis;

a fabric basket rotatably mounted to said shaft for rotation independently of said shaft about said shaft axis, said basket having a basket gripping surface;

an agitator attached to said shaft for rotation with said shaft when said motor is rotating said shaft;

a clutch positioned between said basket and said agitator, said clutch having a clutch gripping surface presented toward said basket gripping surface of said basket;

said clutch being axially movable with respect to said elongated shaft from a disengaged position wherein said clutch gripping surface is spaced from said basket gripping surface to an engaged position wherein said clutch gripping surface and said basket gripping surface retentively engage one another;

said clutch and said agitator engaging one another when said clutch is in said engaged position to prevent relative rotation therebetween whereby said basket, said clutch and said agitator will rotate together when said clutch is in said engaged position;

said clutch being movable from said engaged position to said disengaged position in response to the rise of level of said washing fluid above a predetermined level within said washing basket.

2. An automatic washer according to claim 1 wherein said clutch is floatable in response to the rise of said level of said washing fluid above said predetermined level to move from said engaged position to said disengaged position.

3. An automatic washer according to claim 2 where said clutch is held in said engaged position by gravity when said washing fluid is below said predetermined level.

4. An automatic washer according to claim 1 wherein one of said clutch gripping surface and said basket gripping surface comprises a plurality of ribs and the other of said clutch gripping surface and said basket gripping surface comprises a plurality of teeth which are adapted to mesh with said ribs when said clutch is in said engaged position and which are adapted to move out of meshing engagement with said ribs when said clutch is in said disengaged position.

5. An automatic washer according to claim 1 and further comprising a first guide on said agitator and a second guide on said clutch, said first and second guides engaging one another to prevent rotation of said clutch relative to said agitator when said clutch is in said disengaged and said engaged positions.

6. An automatic washer according to claim 5 wherein one of said first and second guides comprises at least one rib and the other of said first and second guides comprises at least one slot receiving said rib therein and being slidable on said rib.

7. An automatic washer for washing fabrics with a washing fluid comprising;

an outer tub having a tub end wall and a tub side wall forming a tub cavity for holding said washing fluid, said tub end wall having an opening therein and having an interior side and an exterior side;

an elongated shaft having first and second opposite ends and a longitudinal shaft axis, said shaft extending through said opening in said tub end wall;

a washing basket within said tub cavity comprising a basket bottom wall and a basket side wall forming a basket cavity, said basket bottom and side walls having a plurality of perforations therein for letting said washing fluid communicate between said tub cavity and said basket cavity, said washing basket being mounted on said shaft for rotation relative to said shaft about said shaft axis;

an agitator attached to said shaft for rotation with said shaft within said basket cavity of said washing basket;

a motor mounted in fixed relation to said outer tub and being connected to said shaft for rotating said shaft about said shaft axis;

a clutch between said agitator and said washing basket, said clutch being movable between an engaged position coupling said agitator and said washing basket for rotation together during rotation of said shaft and a disengaged position uncoupling said agitator and said washing basket for permitting said agitator to rotate with said shaft independently of said washing basket;

said clutch being axially movable with respect to said elongated shaft from said engaged position to said disengaged position in response to said washing fluid rising above a predetermined height in said washing basket.

8. An automatic washer according to claim 7 wherein said clutch is floatable in response to the rise of said level of said washing fluid above said predetermined level to move from said engaged position to said disengaged position.

9. An automatic washer according to claim 8 wherein said clutch is held in said engaged position by gravity when said washing fluid is below said predetermined level.

10. An automatic laundry washer comprising:

a wash tub for containing wash liquid;

a spin basket rotatably mounted within said wash tub;

an agitator mounted within said spin basket on a drive shaft extending through said spin basket and said wash tub, said agitator including structure juxtaposed to the bottom of said spin basket defining a chamber; and a clutch positioned in said chamber and operable responsive to the level of wash liquid in said spin basket for engaging or disengaging said spin basket from said agitator, one of said clutch and said spin basket including a plurality of ribs and the other of said clutch and said spin basket including a plurality of teeth, said ribs and said teeth being in mesh when said clutch is engaged said clutch being axially movable with respect to said drive shaft.

11. An automatic laundry washer comprising;

an outer tub for containing a washing fluid;

a fabric basket rotatably mounted within said outer tub for rotation relative thereto, said fabric basket having a first gripping surface;

an agitator mounted within said fabric basket and rotatably attached to a drive shaft;

a clutch positioned between said fabric basket and said agitator, said clutch having a second gripping surface presented toward said first gripping surface of said basket;

said clutch being axially movable with respect to said drive shaft from a disengaged position wherein said second gripping surface is spaced from said first gripping surface to an engaged position wherein said second gripping surface and said first gripping surface retentively engage one another;

said clutch and said agitator engaging one another when said clutch is in said engaged position to prevent relative rotation therebetween whereby said basket, said clutch and said agitator rotate together; and said clutch being movable from said engaged position to said disengaged position in response to the rise of level of said washing fluid above a predetermined level.

12. An automatic laundry washer comprising:

a wash tub for containing wash liquid;

a spin basket rotatably mounted within said wash tub and having a bottom wall with a first gripping surface;

an agitator mounted within said spin basket on a drive shaft extending through said spin basket and said wash tub, said agitator including structure defining a chamber adjacent the bottom wall of said spin basket surrounding and coaxial with said drive shaft; and a clutch mounted within said chamber and operable responsive to the level of wash liquid in said wash tub for locking or not locking said spin basket to said agitator, said clutch comprising a floatation device having a second gripping surface mechanically engaging the complimentary first gripping surface, said clutch being axially movable with respect to said drive shaft.

* * * * *